United States Patent [19]

Brawer et al.

[11] Patent Number: 4,991,691

[45] Date of Patent: Feb. 12, 1991

[54] STAIR BARRIER

[76] Inventors: David B. Brawer, 226 Forrest Ave., Narbeth, Pa. 19072; Michael I. Hauptman, 216 Fitzwater St., Philadelphia, Pa. 19147

[21] Appl. No.: 542,738

[22] Filed: Jun. 22, 1990

[51] Int. Cl.[5] ..... E04F 11/00; E06C 7/00

[52] U.S. Cl. ..... 182/106; 182/230; 52/182

[58] Field of Search ..... 182/106, 230, 107, 138; 52/182

[56] References Cited

U.S. PATENT DOCUMENTS

| | | | |
|---|---|---|---|
| 1,235,411 | 7/1917 | Andrews . | |
| 2,270,909 | 1/1942 | Spizer . | |
| 2,535,544 | 12/1950 | McKinley | 182/106 |
| 3,225,863 | 12/1965 | Ludlow | 182/230 |
| 3,303,906 | 2/1967 | Bouwmeester | 182/106 |
| 3,311,195 | 3/1967 | Singer | 182/230 |
| 3,372,772 | 3/1968 | Singer | 182/230 |
| 3,428,146 | 2/1969 | Bair | 182/106 |
| 3,439,775 | 4/1969 | Henrie | 182/138 |
| 3,743,281 | 7/1973 | Gimbel | 272/56.5 R |
| 3,796,429 | 3/1974 | Johnston | 272/56.5 R |
| 4,579,197 | 4/1986 | Spurling | 182/106 |
| 4,664,225 | 5/1987 | Coutier | 182/106 |

*Primary Examiner*—Reinaldo P. Machado

*Attorney, Agent, or Firm*—Eckert Seamans Cherin & Mellott

[57] ABSTRACT

A portable stair barrier intended to prevent very young children from climbing up a stairway is formed by a ramp having support members adapted for rest on the stairway, wherein the ramp bridges over one or more stairs when deployed.

20 Claims, 3 Drawing Sheets

STAIR BARRIER

BACKGROUND OF THE INVENTION

1. Field of the Invention

The invention relates to the field of child-resistant barriers and in particular to a portable stair barrier intended to prevent very young children from climbing up a stairway by providing a stowable ramp which bridges over one or more stairs when deployed.

2. Prior Art

Known stair barriers consist of various styles of gates defining a vertical wall across the stairway. These have the advantage of being mountable as a barrier at either the top or the bottom of a stairway. Such gates lock into place in front of a top or bottom stair, typically by being expanded between two immovable lateral barrier objects defining an entryway to the stairway, usually the walls which border the stairway on both sides, but also perhaps a banister or the like on posts. Such gates are also sometimes mounted on a vertical hinge.

The disadvantage of the gate type of stair barrier is that the gate cannot be used effectively where the stairway is not bordered by immovable lateral barriers on each side such as walls or banisters. Many stairways are bordered by a wall on one side only, at least for several bottom steps. The side opposite the wall may likewise contain a handrail mounted on posts, but the posts are often unsuitable as supports for the gate, either because of their shape, or more commonly because there are no vertical posts in the location where it is desired to position the gate. The supporting posts are sometimes too widely spaced to prevent access by a child. In this situation the gate type of stair barrier either cannot confidently be used at all, or must be mounted in a less than ideal position, for example far enough above the bottom step as to still allow a substantial fall.

The present invention abandons the concept of a vertical barrier in favor of a slide bridging one or more steps. Inclined slides which mount over a stairway are known as play devices for older children. U.S. Pat. No. 2,270,909—Spizer discloses a child's play slide which grips the stairs directly and does not require immovable borders on each side of the stairway in order to be mounted. U.S. Pat. No. 3,743,281—Gimbel and U.S. Pat. No. 3,796,429—Johnston disclose other variations of children's play slides which are mounted on a stairway.

These slides are intended for recreational use by an older child in sliding down, and are not structured or intended safely to prevent a younger child from climbing up. Therefore, the slides run the full length of the stairway. Although the slides are not permanently attached to the stairway, their length is always enough to bridge a substantial number of stairs, which makes them cumbersome to move. They would normally remain attached to the stairway at all times. In order that the stairway may be used in the normal manner to climb the stairs, the width of the slide is typically limited to a child's body width. The stairway thus remains partially unblocked to allow the children themselves to climb back to the top of the slide and to allow others to use the stairs. Accordingly, these types of slides are not suitable for use as stair barriers to prevent young children from crawling up the stairs.

The present invention provides a stair barrier which can be used on any stairway, whether or not the stairway is between two walls. A slide panel is preferably defined to span two steps such that a small child cannot crawl over the barrier to reach an area of the stairs that can be traversed normally. The barrier is adjustable for stairs of different widths, heights, and depths. It can be quickly removed when there are no children present, and preferably it is foldable to define a one step ramp that adults can step over, and in any event requires minimal storage space.

SUMMARY OF THE INVENTION

It is an object of the invention to provide a means for preventing young children from climbing up a stairway by causing them to slide down the lowermost one or two steps.

It is another object of the invention to provide a stair barrier which can be used on a stairway that has no side walls or has banister posts that a child can pass through.

It is another object of the invention to provide a stair barrier which can be easily stowed to allow adult access, or removed, when there are no children present.

It is a further object of the invention to provide a stair barrier which will collapse into a compact size for storage.

It is still another object of the invention to provide a durable and effective, yet inexpensive stair barrier which is universally applicable and adjustable and can be set up and taken down quickly by any adult.

These and other objects are accomplished by an inclined planar member having supports which are dimensioned to rest securely along the edges of one or two lower steps on a stairway. The planar member has means for adjustment of height and width in order that it may be superposed over various sizes of stairs. Preferably the planar member is articulated to unfold over at least two stairs and may be collapsed for storage on a single step, where an adult can easily step over.

BRIEF DESCRIPTION OF THE DRAWINGS

There are shown in the drawings the embodiments of the invention that are presently preferred. It should be understood, however, that the invention is not limited to the precise arrangements and instrumentalities shown in the drawings, wherein.

DETAILED DESCRIPTION OF THE PREFERRED EMBODIMENTS

Figure 1:
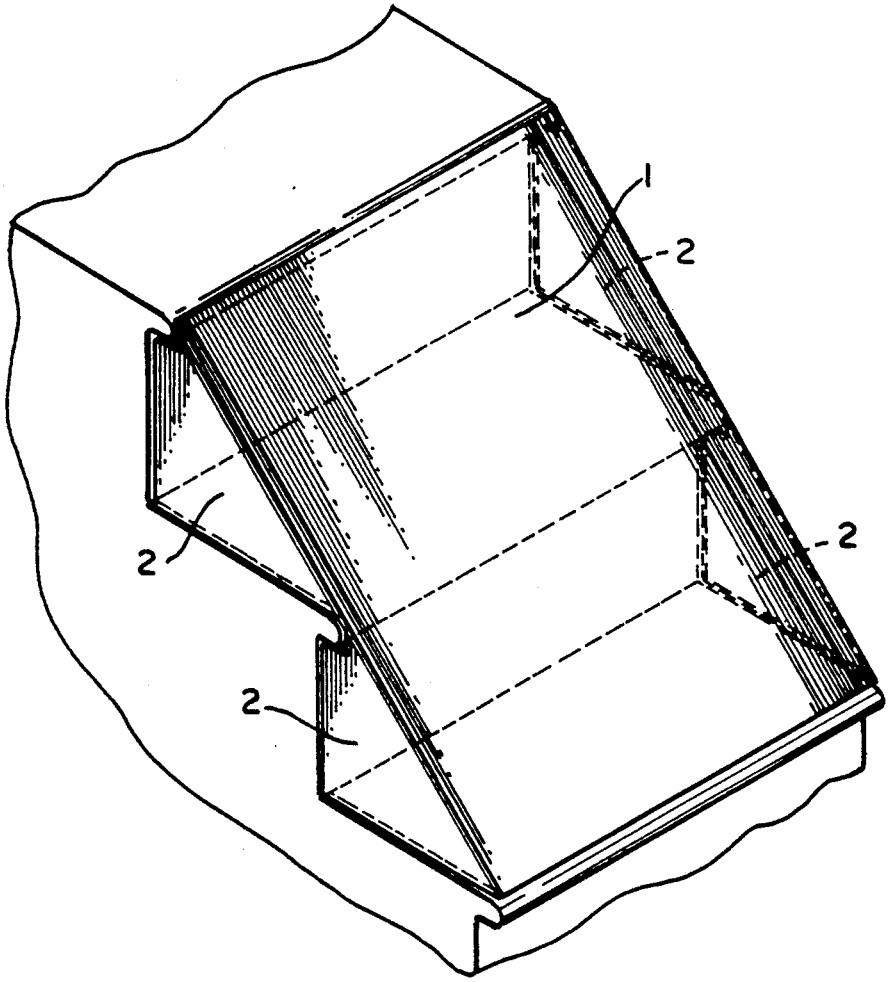
FIG. 1 is a perspective view of a stair barrier according to the invention, shown in position on a stairway.

A stair barrier according to the invention as shown in FIG. 1 has an inclined planar member 1 and support members 2 on the underside of said planar member. The support members are suitably dimensioned to support the planar member at rest along the frontmost edges of the stairs on a stairway. The planar member has a width dimension equal to a full stair width, and length dimension sufficient for superposition over at least two steps. The stair barrier is preferably made from wood and on the operative upper side of the planar member is a low friction surface, although according to the invention the stair barrier can be made from any suitable material. For instance, the stair barrier can be made from hard plastic. Further, the stair barrier may contain metal inserts so that it is sufficiently weighted to keep it firmly in place on the stairway.

The invention provides an effective obstacle to a small child attempting to climb onto the stairway. Crawling children are unable to traverse the planar member to reach the stairs above the obstacle. Toddlers are not so secure as to attempt to walk up the planar member, and cannot step clear over it. Thus, small children are either unwilling or unable to pass the barrier. When in place, the barrier covers two entire stairs. The barrier itself has smooth surfaces which are preferably aligned to the stair but can be more steeply inclined toward vertical so that the child can not climb onto it without sliding back. Unlike gate type stair barriers, the invention merely rests on the stairway with the support members 2 bearing on the steps and supporting planar member 1 in operative position, so it can be used even where the stairway has no adjacent wall or railing.

Each of the support members 2 preferably has a flange or foot at a location which bears on the steps to provide increased stability to the operative stair barrier. The flanges or feet may further contain a skid-resistant bottom surface produced by attaching rubber pads, a sheet or coating of granular material, or the like, to prevent the stair barrier from being accidentally knocked off the stairway by either a playing child or an adult. The support members are preferably triangular so as to bear flush against a stair tread and adjacent riser, and to eliminate possible finger and toe holds which the child might reach. The support members may also be columnar, inverted T-shaped, L-shaped, or other suitable structure. Additionally, the number of support members and their location under the planar member may be configured for a best combination.

Figure 2:
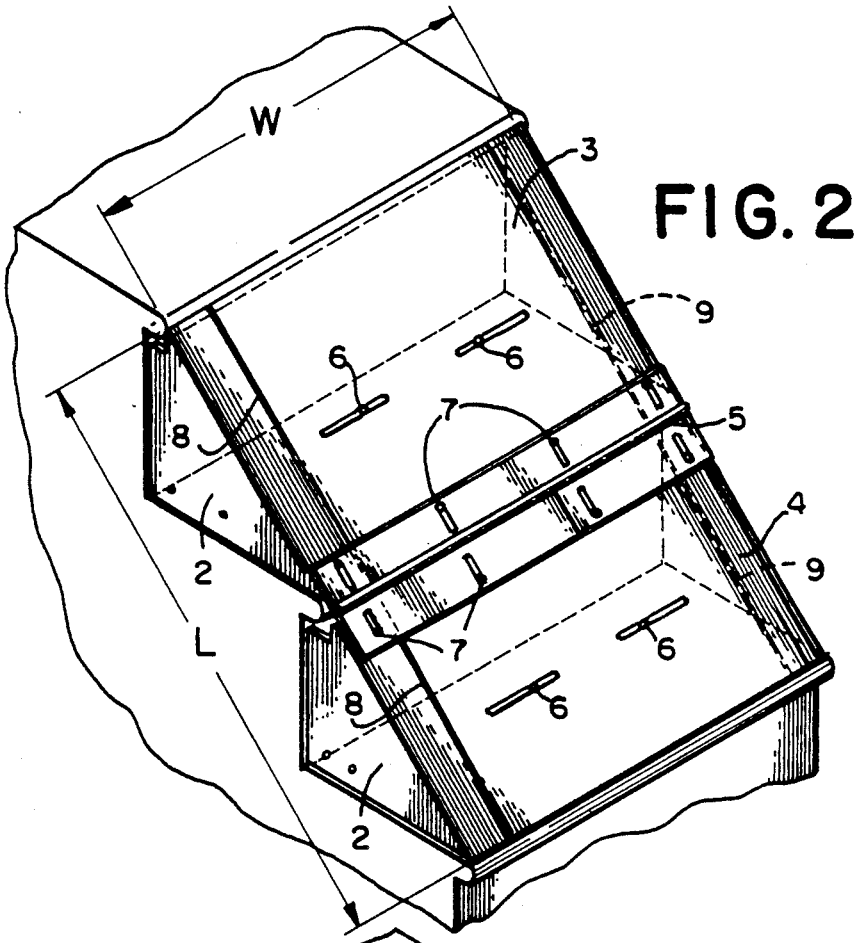
FIG. 2 is a perspective view of the invention having folding means and means for adjusting length and width dimensions.

A preferred embodiment of the invention is shown in FIG. 2, wherein the inclined planar member comprises an upper slide panel 3, a lower slide panel 4, and folding means 5 between said upper and lower slide panels. The folding means 5 can be a hinge made of wood, metal, hard plastic or any other suitable material. Alternatively, the folding means can be a flexible material which is attached between the upper and lower slide panels to define a surface which continuously lacks a secure finger or toe hold.

Figure 3:
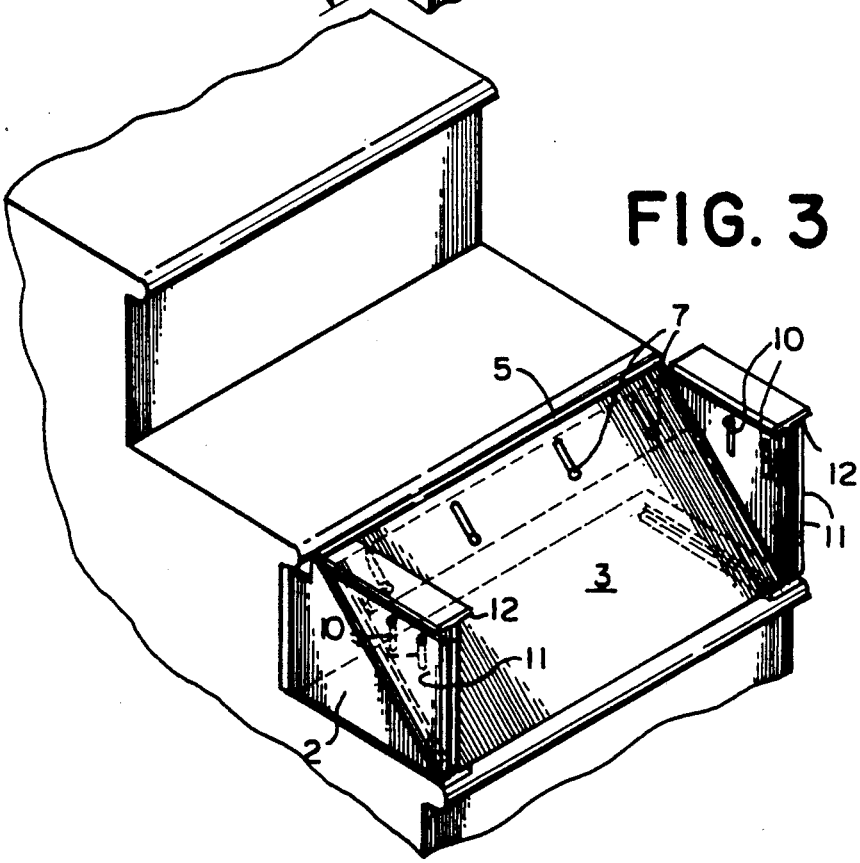
FIG. 3 is a perspective view of the invention on a stairway, shown with a top panel folded down onto a bottom panel.
Figure 4:
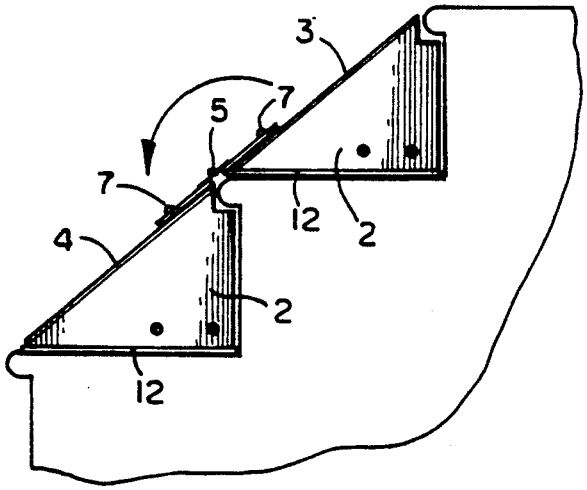
FIG. 4 is a side elevation view of the invention on a stairway in an position.
Figure 5:
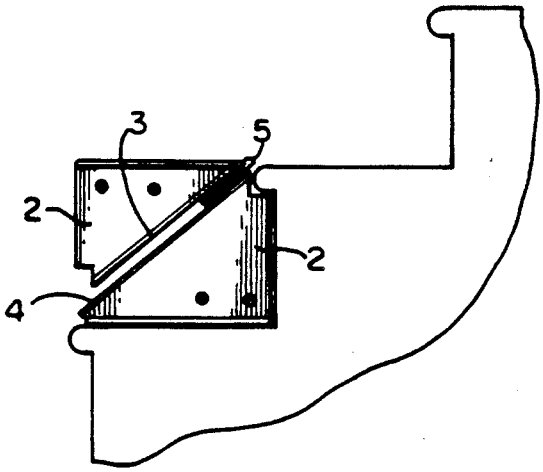
FIG. 5 is a side elevation view of the invention on a stairway, shown with the top panel folded down onto the bottom panel.

In the embodiment of FIGS. 2 and 3, the stair barrier can be folded to reside on one stair only, or folded for stowage and removed when there is no child in the room. FIG. 3 shows the stair barrier on the stairway with the upper panel folded over at the articulation or hinge between the upper and lower panels to an at-rest position where the upper panel rests on the lower panel. The stair barrier can be left on the stairway in this position, allowing most adults to use the stairway by taking a long step over the barrier. To some extent, the slide thus defined over one step will discourage passage by a child, especially when the barrier is placed on the second or third step rather than on the surface adjacent the first riser. Preferably, the entire barrier is removed from the stairway when unneeded and stored in an out of the way location to avoid having an adult inadvertently step on the barrier and fall. The barrier can be brightly colored to reduce this possibility.

Figure 6:
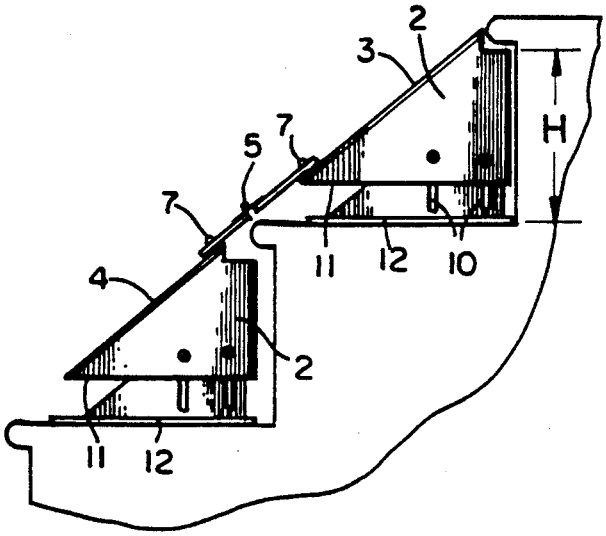
FIG. 6 is a side elevation view of the invention on a stairway in the open position, with means for adjusting a height dimension.

Another embodiment of the invention comprises means for adjusting a width dimension W and a length dimension L, shown in FIG. 2, and height dimension H, shown in FIG. 6, in order that the barrier can be used on stairways having treads or risers of different sizes. To some degree stairs are standardized, however there are several standards apt for different stair types. This embodiment provides dimensional adjustment which enables the barrier to be used on virtually all stair types. The panel member 1 and support members 2 are made in overlapping panels which can slide relative to one another in telescoping fashion to adjust in dimensions. Dimensional adjustment is accomplished by means of protrusions in one of the respective panels sliding in elongated slots in the other of the panels. The protrusions may be screws having nuts which are tightened in order to hold a desired dimension. At least two slots are necessary for each adjustable dimension in order to prevent one sliding member from being rotatable with respect to its companion sliding member. More than two slots can be employed for each adjustable dimension wherever the sliding panels are large. The slots are sufficiently long so that the stair barrier can be adjusted to rest firmly on any stairway and fully cover at least two steps.

In FIG. 2, upper panel 3 is comprised of right-hand member 8 and left-hand member 9, slidably attached by screws in elongated slots 6. The screws can be in either member 8 or 9, with the slots in the other. An identical arrangement is provided by lower panel 4. The stair barrier is fitted to the stairway by sliding the left and right-hand members to a position required to cover a full stair width, with the support members 2 at or near the extreme edges. One or more additional supports (not shown) between the supports 2 are possible, but optional, provided the supports do not interfere with adjustability. The folding means or hinge 5 can be limited to the minimum width or provided with removable extensions at one end in order that the folding means can be adjusted for dimensional compatibility with the upper and lower panels.

The length dimension L is adjustable by means of screws in elongated slots 7 which attach the folding means or hinge 5 to the upper and lower panel members. When the stair barrier is adjusted to its shortest length, the upper and lower panels approach each other edgewise at the folding means. When the stair barrier is adjusted to its maximum length, the upper and lower panel members move to their farthest edgewise separation, and the folding means spans the gap left between the panel members.

Means for adjusting the height dimension H is shown in FIG. 6. Each of the support members 2 is comprised of an upper support member 11 and a lower support member 12 slidably attached by means of screws in elongated slots 10. When the stair barrier is being used, the height dimension is adjusted to provide firm support for the stair barrier at rest on the stairway.

The stair barrier according to the invention will normally be configured to completely cover two stairs. The stair barrier can be manufactured so that it covers more than two stairs by increasing the length of the planar member 1 and adding support members 2 to the increased length. If desired., two or more hinges 5 can be incorporated into the stair barrier to permit folding of lengthier designs.

I claim:

1. A stair barrier comprising:

a planar member to be inclined over treads of stairs on a stairway, said planar member having a width dimension sufficient to block passage of a child up the stairway, and a length dimension sufficient for superposition over at least two stairs, said stair barrier further comprising at least one support member on the underside of said planar member, said support member having a height dimension sufficient to support the planar member at rest on the stairway.

2. The stair barrier of claim 1, wherein the stair barrier comprises at least two support members at a space from each other on the underside of said planar member.

3. The stair barrier of claim 1, wherein the stair barrier is adjustable in at least one of the dimensions of width, length, and height.

4. The stair barrier of claim 1, wherein the stair barrier is adjustable in width.

5. A stair barrier comprising:

a planar member having a sliding surface to be disposed over a portion of a stairway, said planar member having a width dimension sufficient to block passage of a child up the stairway, and a length dimension sufficient for superposition over at least two stairs, said planar member comprising an upper panel, a lower panel, and articulation means between said upper and lower panels, said stair barrier further comprising at least one support member on the underside of said planar member, said support member having a height dimension sufficient to support the planar member at rest on a stairway.

6. The stair barrier of claim 5, wherein the stair barrier comprises at least two support members at a space from each other on the underside of said planar member.

7. The stair barrier of claim 5, wherein the articulation means is a hinge.

8. The stair barrier of claim 5, wherein the articulation means is a flexible material.

9. The stair barrier of claim 5, wherein at least one of the dimensions of width, length, and height is adjustable.

10. The stair barrier of claim 5, wherein the stair barrier is adjustable in width.

11. A stair barrier comprising:

a planar member, said planar member having an adjustable width dimension, and an adjustable length dimension, said planar member comprising an upper panel, a lower panel, and articulation means between said upper and lower panels, said stair barrier further comprising at least one support member on the underside of said planar member, said support member having an adjustable height dimension, whereby the stair barrier can be adjusted to stairways of different dimensions such that the planar member is inclined to cover at least one complete riser and tread of the stairway.

12. The stair barrier of claim 11, wherein the articulation means is a hinge.

13. The stair barrier of claim 11, wherein the articulation means is a flexible material.

14. The stair barrier of claim 11, wherein the upper and lower panels are telescopically attached to each other.

15. The stair barrier of claim 11, wherein the upper and lower panels each comprise a left hand member and a right hand member telescopically attached to each other.

16. The stair barrier of claim 11, wherein the upper and lower panels each comprise a left hand member and a right hand member slidably attached to each other, wherein the width dimension is adjustable by means comprising protrusions slidable in elongated slots.

17. The stair barrier of claim 11, wherein the support members are each comprised of an upper support member and a lower support member slidably attached to each other, wherein the height dimension is adjustable by means comprising protrusions slidable in elongated slots.

18. The stair barrier of claim 11, wherein the length dimension is adjustable by means comprising protrusions slidable in elongated slots.

19. The stair barrier of claim 11, wherein at least one said dimension is adjustable by means of telescoping.

20. The stair barrier of claim 11, wherein the support members are each comprised of an upper support member an a lower support member telescopically attached to each other.

* * * * *